US011615749B2

(12) United States Patent
Nam et al.

(10) Patent No.: US 11,615,749 B2
(45) Date of Patent: Mar. 28, 2023

(54) DISPLAY APPARATUS AND METHOD OF DRIVING DISPLAY PANEL USING THE SAME

(71) Applicant: Samsung Display Co., Ltd., Yongin-si (KR)

(72) Inventors: Hui Nam, Suwon-si (KR); Hyo Jin Lee, Yongin-si (KR); Jinyoung Roh, Hwaseong-si (KR); Sehyuk Park, Seongnam-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/379,929

(22) Filed: Jul. 19, 2021

(65) Prior Publication Data

US 2021/0343245 A1 Nov. 4, 2021

Related U.S. Application Data

(63) Continuation of application No. 16/579,476, filed on Sep. 23, 2019, now Pat. No. 11,069,295.

(30) Foreign Application Priority Data

Oct. 4, 2018 (KR) ..... 10-2018-0118192

(51) Int. Cl.
*G09G 3/3258* (2016.01)
*G09G 3/3266* (2016.01)
*G09G 3/3291* (2016.01)

(52) U.S. Cl.
CPC ..... *G09G 3/3258* (2013.01); *G09G 3/3266* (2013.01); *G09G 3/3291* (2013.01);
(Continued)

(58) Field of Classification Search
CPC .. G09G 3/3258; G09G 3/3266; G09G 3/3291; G09G 2300/08; G09G 2330/021;
(Continued)

(56) References Cited

U.S. PATENT DOCUMENTS 9,412,303 B2 8/2016 Kim et al.
10,916,199 B2 * 2/2021 Zhu ..... G09G 3/3266
(Continued)

FOREIGN PATENT DOCUMENTS

KR 10-0168477 B1 3/1999
KR 10-0433102 B1 5/2004
(Continued)

*Primary Examiner* — Carolyn R Edwards
(74) *Attorney, Agent, or Firm* — Lewis Roca Rothgerber Christie LLP

(57) ABSTRACT

A display apparatus includes a display panel, a gate driver, a data driver and an emission driver. The display panel includes a pixel. The gate driver outputs a data write gate signal having a corresponding active level and a data initialization gate signal having a corresponding active level to the pixel in a writing frame, outputs the data write gate signal not having the corresponding active level and the data initialization gate signal not having the corresponding active level to the pixel in a holding frame and outputs the data write gate signal having the corresponding active level and the data initialization gate signal not having the corresponding active level to the pixel in a writing compensation frame. The data driver outputs a data voltage to the pixel. The emission driver outputs an emission signal to the pixel.

17 Claims, 13 Drawing Sheets

(52) U.S. Cl.
CPC . *G09G 2300/0426* (2013.01); *G09G 2300/08* (2013.01); *G09G 2320/0247* (2013.01); *G09G 2330/021* (2013.01)

(58) Field of Classification Search
CPC ... G09G 2300/0426; G09G 2320/0247; G09G 2300/0861; G09G 2300/0819; G09G 2310/0262; G09G 2300/0842; G09G 3/3233; G09G 2340/0435
See application file for complete search history.

(56) References Cited

U.S. PATENT DOCUMENTS

2004/0196239 A1* 10/2004 Kwon ..... G09G 3/325 345/39
2016/0035260 A1 2/2016 Kim et al.
2016/0321991 A1* 11/2016 Song ..... H01L 51/5218
2017/0069273 A1* 3/2017 Park ..... G09G 3/3233
2017/0365213 A1* 12/2017 Rieutort-Louis .... G09G 3/3233
2017/0365214 A1* 12/2017 Tsai ..... G09G 3/3233
2017/0371462 A1* 12/2017 Kim ..... G06V 40/1306
2018/0033365 A1* 2/2018 Zhang ..... G09G 3/3233
2018/0075808 A1* 3/2018 Yamashita ..... G09G 3/3266
2018/0075809 A1* 3/2018 Chang ..... G09G 3/3266
2018/0190197 A1* 7/2018 Chang ..... G09G 3/3233
2018/0293939 A1* 10/2018 Kim ..... H01L 51/5203
2019/0318692 A1* 10/2019 Jiang ..... H01L 27/3276
2020/0243014 A1* 7/2020 Zhu ..... G09G 3/3266
2020/0286417 A1* 9/2020 Chae ..... G09G 3/20

FOREIGN PATENT DOCUMENTS

KR 10-0681774 B1 2/2007
KR 10-2015-0146117 A 12/2015
KR 10-2016-0015451 A 2/2016
KR 10-2017-0031321 A 3/2017
KR 10-2018-0004369 A 1/2018

* cited by examiner

DISPLAY APPARATUS AND METHOD OF DRIVING DISPLAY PANEL USING THE SAME

CROSS-REFERENCE TO RELATED APPLICATIONS

This application is a continuation of U.S. patent application Ser. No. 16/579,476, filed Sep. 23, 2019, which claims priority to and the benefit of Korean Patent Application No. 10-2018-0118192, filed Oct. 4, 2018, the entire content of both of which is incorporated herein by reference.

BACKGROUND

1. Field

Aspects of some example embodiments of the present inventive concept relate to a display apparatus and a method of driving a display panel using the display apparatus.

2. Description of the Related Art

Generally, a display apparatus includes a display panel and a display panel driver. The display panel includes a plurality of gate lines, a plurality of data lines, a plurality of emission lines, and a plurality of pixels. The display panel driver includes a gate driver, a data driver, an emission driver, and a driving controller. The gate driver outputs gate signals to the gate lines. The data driver outputs data voltages to the data lines. The emission driver outputs emission signals to the emission lines. The driving controller controls the gate driver, the data driver, and the emission driver.

When the display panel displays a static image or the display panel is operated in Always On Mode, a driving frequency of the display panel may be reduced to reduce the power consumption.

When the driving frequency of the display panel is reduced, a flicker may be generated due to luminance differences between a writing frame and a holding frame due to a hysteresis of a driving transistor.

The above information disclosed in this Background section is only for enhancement of understanding of the background of the invention and therefore it may contain information that does not constitute prior art that is already known in this country to a person of ordinary skill in the art.

SUMMARY

Aspects of some example embodiments of the present inventive concept relate to a display apparatus and a method of driving a display panel using the display apparatus. For example, some example embodiments of the present inventive concept relate to a display apparatus reducing a power consumption and enhancing a display quality and a method of driving a display panel using the display apparatus.

Aspects of some example embodiments of the present inventive concept include a display apparatus capable of reducing a power consumption of a display apparatus and enhancing a display quality of a display panel.

Aspects of some example embodiments of the present inventive concept may also include a method of driving a display panel using the display apparatus.

In an example embodiment of a display apparatus according to the present inventive concept, the display apparatus includes a display panel, a gate driver, a data driver and an emission driver. The display panel includes a pixel. The gate driver is configured to output a data write gate signal having a corresponding active level and a data initialization gate signal having a corresponding active level to the pixel in a writing frame, configured to output the data write gate signal not having the corresponding active level and the data initialization gate signal not having the corresponding active level to the pixel in a holding frame and configured to output the data write gate signal having the corresponding active level and the data initialization gate signal not having the corresponding active level to the pixel in a writing compensation frame. The data driver is configured to output a data voltage to the pixel. The emission driver configured to output an emission signal to the pixel.

In some example embodiments, the writing compensation frame may be right after the writing frame.

In some example embodiments, the data driver may be configured to output a first data voltage for a target grayscale to the pixel in the writing frame and a second data voltage for the target grayscale different from the first data voltage to the pixel in the writing compensation frame.

In some example embodiments, the data driver may be configured to output a holding data voltage not related with the target grayscale to the pixel in the holding frame.

In some example embodiments, a second luminance corresponding to the second data voltage may be less than a first luminance corresponding to the first data voltage.

In some example embodiments, the gate driver may be configured to output the data write gate signal having the corresponding active level and the data initialization gate signal not having the corresponding active level to the pixel in a second writing compensation frame. The second writing compensation frame may be right after the writing compensation frame.

In some example embodiments, the data driver may be configured to output a first data voltage for a target grayscale to the pixel in the writing frame, a second data voltage for the target grayscale different from the first data voltage to the pixel in the writing compensation frame and a third data voltage for the target grayscale different from the first data voltage and the second data voltage to the pixel in the second writing compensation frame.

In some example embodiments, a second luminance corresponding to the second data voltage may be less than a first luminance corresponding to the first data voltage. A third luminance corresponding to the third data voltage may be less than the second luminance corresponding to the second data voltage.

In some example embodiments, the pixel may include a switching element of a first type and a switching element of a second type different from the first type.

In some example embodiments, the switching element of the first type may be a polysilicon thin film transistor. The switching element of the second type may be an oxide thin film transistor.

In some example embodiments, the switching element of the first type may be a P-type transistor. The switching element of the second type may be an N-type transistor.

In some example embodiments, the pixel may include a first pixel switching element comprising a control electrode connected to a first node, an input electrode connected to a second node and an output electrode connected to a third node, a second pixel switching element comprising a control electrode to which a first data write gate signal is applied, an input electrode to which the data voltage is applied and an output electrode connected to the second node, a third pixel switching element comprising a control electrode to which a second data write gate signal is applied, an input electrode connected to the first node and an output electrode connected to the third node, a fourth pixel switching element comprising a control electrode to which the data initialization gate signal is applied, an input electrode to which an initialization voltage is applied and an output electrode connected to the first node, a fifth pixel switching element comprising a control electrode to which the emission signal is applied, an input electrode to which a high power voltage is applied and an output electrode connected to the second node, a sixth pixel switching element comprising a control electrode to which the emission signal is applied, an input electrode connected to the third node and an output electrode connected to an anode electrode of an organic light emitting element, a seventh pixel switching element comprising a control electrode to which an organic light emitting element initialization gate signal is applied, an input electrode to which the initialization voltage is applied and an output electrode connected to the anode electrode of the organic light emitting element, a storage capacitor comprising a first electrode to which the high power voltage is applied and a second electrode connected to the first node and the organic light emitting element comprising the anode electrode connected to the output electrode of the sixth switching element and a cathode electrode to which a low power voltage is applied. The data write gate signal may be the second data write gate signal.

In some example embodiments, the first pixel switching element, the second pixel switching element, the fifth pixel switching element and the sixth pixel switching element may be the polysilicon thin film transistors. The third pixel switching element, the fourth pixel switching element and the seventh pixel switching element may be the oxide thin film transistors.

In some example embodiments, the control electrode of the third pixel switching element may be connected to the control electrode of the seventh pixel switching element.

In some example embodiments, the first pixel switching element, the second pixel switching element, the fifth pixel switching element, the sixth pixel switching element and the seventh pixel switching element may be the polysilicon thin film transistors. The third pixel switching element and the fourth pixel switching element may be the oxide thin film transistors.

In some example embodiments, when a display mode of the display apparatus is a low frequency driving mode and a grayscale value of the data voltage is less than a threshold grayscale value, the data driver may be configured to output a first data voltage to the pixel in the writing frame and a second data voltage different from the first data voltage to the pixel in the writing compensation frame. When the display mode is not the low frequency driving mode or the grayscale value of the data voltage is equal to or greater than the threshold grayscale value, the data driver may be configured to output the first data voltage to the pixel in the writing frame and the first data voltage to the pixel in the writing compensation frame.

In some example embodiments, when a display mode of the display apparatus is a low frequency driving mode and a grayscale value of the data voltage is less than a threshold grayscale value, the gate driver may be configured to generate the writing compensation frame. When the display mode is not the low frequency driving mode or the grayscale value of the data voltage is equal to or greater than the threshold grayscale value, the gate driver may be configured not to generate the writing compensation frame.

In some example embodiments of a method of driving a display panel, the method includes outputting a data write gate signal having a corresponding active level and a data initialization gate signal having a corresponding active level to a pixel of the display panel in a writing frame, outputting the data write gate signal not having the corresponding active level and the data initialization gate signal not having the corresponding active level to the pixel in a holding frame, outputting the data write gate signal having the corresponding active level and the data initialization gate signal not having the corresponding active level to the pixel in a writing compensation frame, outputting a data voltage to the pixel and outputting an emission signal to the pixel.

In some example embodiments, the writing compensation frame may be right after the writing frame.

In some example embodiments, the pixel may include a switching element of a first type and a switching element of a second type different from the first type.

According to the display apparatus and the method of driving the display panel, a writing compensation frame, which has a data initialization gate signal having an inactive level and a data write gate signal having an active level, is inserted after a writing frame in a low frequency driving mode so that the flicker due to the luminance differences between the writing frame and the holding frame may be prevented.

The flicker of the display panel is prevented or reduced in the low frequency driving mode so that the power consumption of the display apparatus may be reduced and the display quality of the display panel may be enhanced.

BRIEF DESCRIPTION OF THE DRAWINGS

The above and other features and characteristics of the present inventive concept will become more apparent by describing, in more detail, aspects of some example embodiments thereof with reference to the accompanying drawings, in which.

DETAILED DESCRIPTION

Hereinafter, aspects of some example embodiments of the present inventive concept will be explained in more detail with reference to the accompanying drawings.

Figure 1:
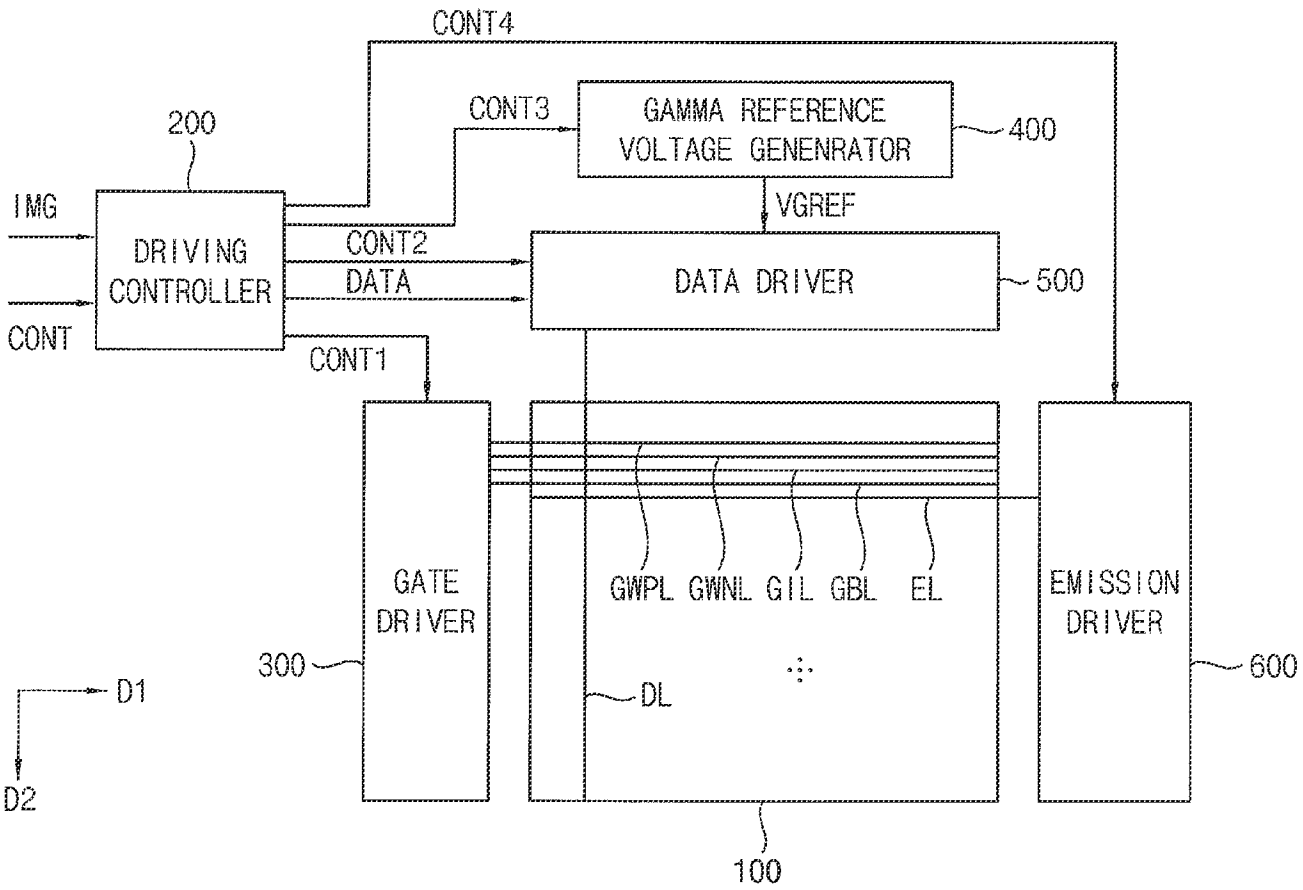
FIG. 1 is a block diagram illustrating a display apparatus according to some example embodiments of the present inventive concept.

FIG. 1 is a block diagram illustrating a display apparatus according to some example embodiments of the present inventive concept.

Referring to FIG. 1, the display apparatus includes a display panel 100 and a display panel driver. The display panel driver includes a driving controller 200, a gate driver 300, a gamma reference voltage generator 400, a data driver 500 and an emission driver 600.

The display panel 100 has a display region on which an image is displayed and a peripheral region adjacent to the display region.

The display panel 100 includes a plurality of gate lines GWPL, GWNL, GIL and GBL, a plurality of data lines DL, a plurality of emission lines EL and a plurality of pixels electrically connected to the gate lines GWPL, GWNL, GIL and GBL, the data lines DL and the emission lines EL. The gate lines GWPL, GWNL, GIL and GBL may extend in a first direction D1, the data lines DL may extend in a second direction D2 crossing the first direction D1 and the emission lines EL may extend in the first direction D1.

The driving controller 200 receives input image data IMG and an input control signal CONT from an external apparatus. For example, the input image data IMG may include red image data, green image data and blue image data. The input image data IMG may include white image data. The input image data IMG may include magenta image data, cyan image data and yellow image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, a fourth control signal CONT4 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The driving controller 200 generates the fourth control signal CONT4 for controlling an operation of the emission driver 600 based on the input control signal CONT, and outputs the fourth control signal CONT4 to the emission driver 600.

The gate driver 300 generates gate signals driving the gate lines GWPL, GWNL, GIL and GBL in response to the first control signal CONT1 received from the driving controller 200. The gate driver 300 may sequentially output the gate signals to the gate lines GWPL, GWNL, GIL and GBL.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In some example embodiments, the gamma reference voltage generator 400 may be located in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The emission driver 600 generates emission signals to drive the emission lines EL in response to the fourth control signal CONT4 received from the driving controller 200. The emission driver 600 may output the emission signals to the emission lines EL.

Figure 2:
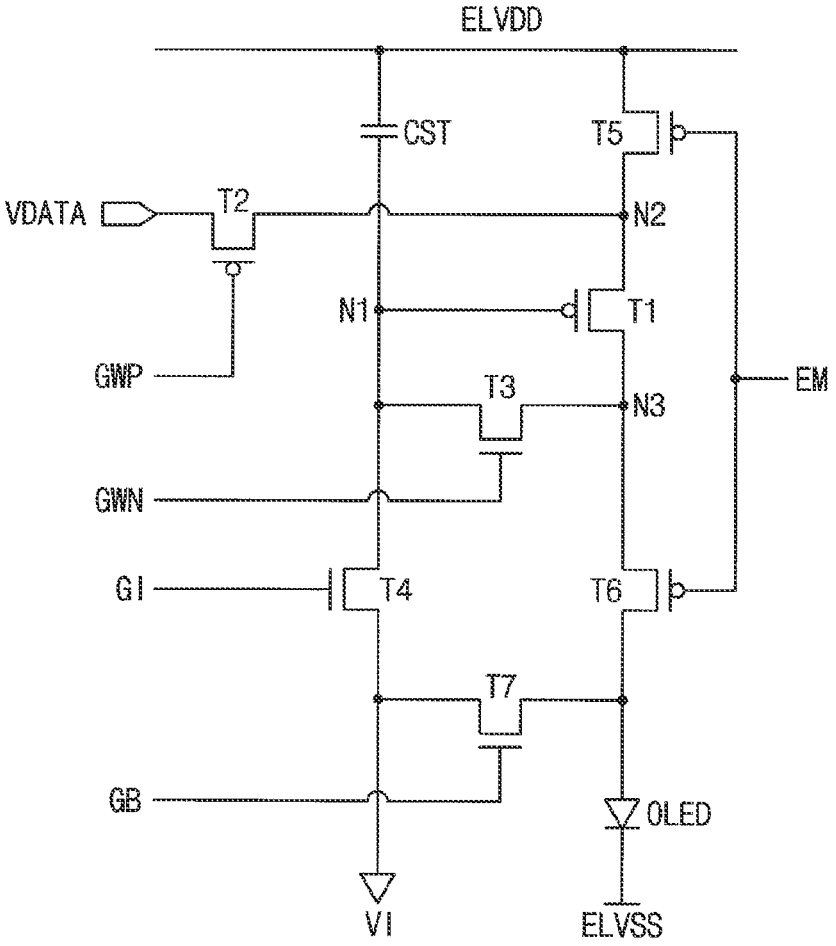
FIG. 2 is a circuit diagram illustrating a pixel of a display panel of FIG. 1.
Figure 3:
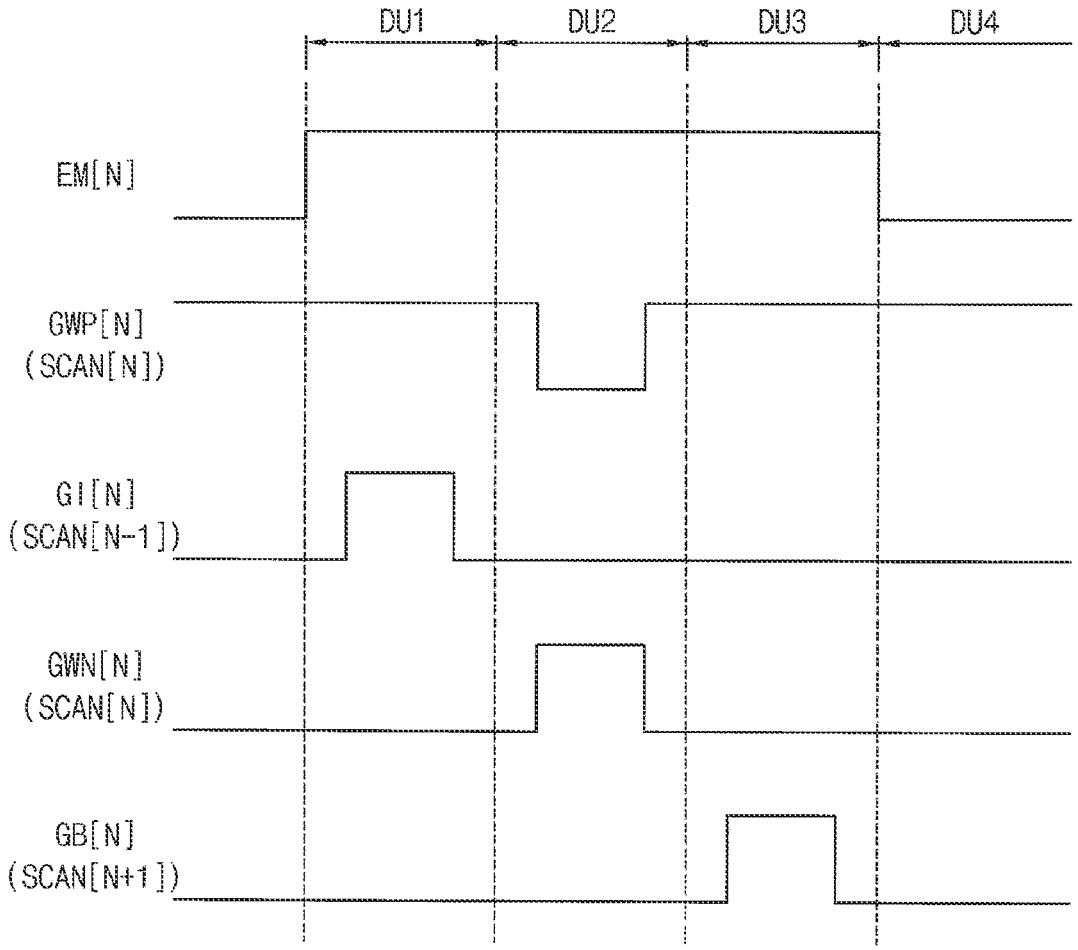
FIG. 3 is a timing diagram illustrating input signals applied to the pixel of FIG. 2.

FIG. 2 is a circuit diagram illustrating a pixel of the display panel 100 of FIG. 1. FIG. 3 is a timing diagram illustrating input signals applied to the pixel of FIG. 2.

Referring to FIGS. 1 to 3, the display panel 100 includes the plurality of the pixels. Each pixel includes an organic light emitting element OLED.

The pixel receives a data write gate signal GWP and GWN, a data initialization gate signal GI, an organic light emitting element initialization signal GB, the data voltage VDATA and the emission signal EM and the organic light emitting element OLED of the pixel emits light corresponding to the level of the data voltage VDATA to display the image.

In some example embodiments, the pixel may include a switching element of a first type and a switching element of a second type different from the first type. For example, the switching element of the first type may be a polysilicon thin film transistor. For example, the switching element of the first type may be a low temperature polysilicon (LTPS) thin film transistor. For example, the switching element of the second type may be an oxide thin film transistor. For example, the switching element of the first type may be a P-type transistor and the switching element of the second type may be an N-type transistor.

For example, the data write gate signal may include a first data write gate signal GWP and a second data write gate signal GWN. The first data write gate signal GWP may be applied to the P-type transistor so that the first data write gate signal GWP has an activation signal of a low level corresponding to a data writing timing. The second data write gate signal GWN may be applied to the N-type transistor so that the second data write gate signal GWN has an activation signal of a high level corresponding to the data writing timing.

At least one of the pixels may include first to seventh pixel switching elements T1 to T7, a storage capacitor CST and the organic light emitting element OLED.

The first pixel switching element T1 includes a control electrode connected to a first node N1, an input electrode connected to a second node N2 and an output electrode connected to a third node N3.

For example, the first pixel switching element T1 may be the polysilicon thin film transistor. For example, the first pixel switching element T1 may be the P-type thin film transistor. The control electrode of the first pixel switching element T1 may be a gate electrode, the input electrode of the first pixel switching element T1 may be a source electrode and the output electrode of the first pixel switching element T1 may be a drain electrode.

The second pixel switching element T2 includes a control electrode to which the first data write gate signal GWP is applied, an input electrode to which the data voltage VDATA is applied and an output electrode connected to the second node N2.

For example, the second pixel switching element T2 may be the polysilicon thin film transistor. For example, the second pixel switching element T2 may be the P-type thin film transistor. The control electrode of the second pixel switching element T2 may be a gate electrode, the input electrode of the second pixel switching element T2 may be a source electrode and the output electrode of the second pixel switching element T2 may be a drain electrode.

The third pixel switching element T3 includes a control electrode to which the second data write gate signal GWN is applied, an input electrode connected to the first node N1 and an output electrode connected to the third node N3.

For example, the third pixel switching element T3 may be the oxide thin film transistor. For example, the third pixel switching element T3 may be the N-type thin film transistor. The control electrode of the third pixel switching element T3 may be a gate electrode, the input electrode of the third pixel switching element T3 may be a source electrode and the output electrode of the third pixel switching element T3 may be a drain electrode.

The fourth pixel switching element T4 includes a control electrode to which the data initialization gate signal GI is applied, an input electrode to which an initialization voltage VI is applied and an output electrode connected to the first node N1.

For example, the fourth pixel switching element T4 may be the oxide thin film transistor. For example, the fourth pixel switching element T4 may be the N-type thin film transistor. The control electrode of the fourth pixel switching element T4 may be a gate electrode, the input electrode of the fourth pixel switching element T4 may be a source electrode and the output electrode of the fourth pixel switching element T4 may be a drain electrode.

The fifth pixel switching element T5 includes a control electrode to which the emission signal EM is applied, an input electrode to which a high power voltage ELVDD is applied and an output electrode connected to the second node N2.

For example, the fifth pixel switching element T5 may be the polysilicon thin film transistor. For example, the fifth pixel switching element T5 may be the P-type thin film transistor. The control electrode of the fifth pixel switching element T5 may be a gate electrode, the input electrode of the fifth pixel switching element T5 may be a source electrode and the output electrode of the fifth pixel switching element T5 may be a drain electrode.

The sixth pixel switching element T6 includes a control electrode to which the emission signal EM is applied, an input electrode connected to the third node N3 and an output electrode connected to an anode electrode of the organic light emitting element OLED.

For example, the sixth pixel switching element T6 may be the polysilicon thin film transistor. For example, the sixth pixel switching element T6 may be a P-type thin film transistor. The control electrode of the sixth pixel switching element T6 may be a gate electrode, the input electrode of the sixth pixel switching element T6 may be a source electrode and the output electrode of the sixth pixel switching element T6 may be a drain electrode.

The seventh pixel switching element T7 includes a control electrode to which the organic light emitting element initialization gate signal GB is applied, an input electrode to which the initialization voltage VI is applied and an output electrode connected to the anode electrode of the organic light emitting element OLED.

For example, the seventh pixel switching element T7 may be the oxide thin film transistor. For example, the seventh pixel switching element T7 may be the N-type thin film transistor. The control electrode of the seventh pixel switching element T7 may be a gate electrode, the input electrode of the seventh pixel switching element T7 may be a source electrode and the output electrode of the seventh pixel switching element T7 may be a drain electrode.

The storage capacitor CST includes a first electrode to which the high power voltage ELVDD is applied and a second electrode connected to the first node N1.

The organic light emitting element OLED includes the anode electrode and a cathode electrode to which a low power voltage ELVSS is applied.

In FIG. 3, during a first duration (or time period) DU1, the first node N1 and the storage capacitor CST are initialized in response to the data initialization gate signal GI. During a second duration (or time period) DU2, a threshold voltage |VTH| of the first pixel switching element T1 is compensated and the data voltage VDATA of which the threshold voltage |VTH| is compensated is written to the first node N1 in response to the first and second data write gate signals GWP and GWN. During a third duration (or time period) DU3, the anode electrode of the organic light emitting element OLED is initialized in response to the organic light emitting element initialization gate signal GB. During a fourth duration (or time period) DU4, the organic light emitting element OLED emit the light in response to the emission signal EM so that the display panel 100 displays the image.

Although an emission off duration of the emission signal EM corresponds to first to third durations DU1, DU2 and DU3 in the present example embodiment, embodiments of the present inventive concept are not limited thereto. The emission off duration of the emission signal EM may be set to include the data writing duration DU2. The emission off duration of the emission signal EM may be longer than a sum of the first to third durations DU1, DU2 and DU3.

During the first duration DU1, the data initialization gate signal GI may have an active level. For example, the active level of the data initialization gate signal GI may be a high level. When the data initialization gate signal GI has the active level, the fourth pixel switching element T4 is turned on so that the initialization voltage VI may be applied to the first node N1. The data initialization gate signal GI[N] of a present stage may be generated based on a scan signal SCAN[N−1] of a previous stage.

During the second duration DU2, the first data write gate signal GWP and the second data write gate signal GWN may have an active level. For example, the active level of the first data write gate signal GWP may be a low level and the active level of the second data write gate signal GWN may be a high level. When the first data write gate signal GWP and the second data writhe gate signal GWN have the active level, the second pixel switching element T2 and the third pixel switching element T3 are turned on. In addition, the first pixel switching element T1 is turned on in response to the initialization voltage VI. The first data write gate signal GWP[N] of the present stage may be generated based on a scan signal SCAN[N] of the present stage. The second data write gate signal GWN[N] of the present stage may be generated based on the scan signal SCAN[N] of the present stage.

A voltage which is a subtraction of an absolute value |VTH| of the threshold voltage of the first pixel switching element T1 from the data voltage VDATA may be charged at the first node N1 along a path generated by the first to third pixel switching elements T1, T2 and T3.

During the third duration DU3, the organic light emitting element initialization signal GB may have an active level. For example, the active level of the organic light emitting element initialization signal GB may be a high level. When the organic light emitting element initialization signal GB has the active level, the seventh pixel switching element T7 is turned on so that the initialization voltage VI may be applied to the anode electrode of the organic light emitting element OLED. The organic light emitting element initialization signal GB[N] of the present stage may be generated based on a scan signal SCAN[N+1] of a next stage.

During the fourth duration DU4, the emission signal EM may have an active level. The active level of the emission signal EM may be a low level. When the emission signal EM has the active level, the fifth pixel switching element T5 and the sixth pixel switching element T6 are turned on. In addition, the first pixel switching element T1 is turned on by the data voltage VDATA.

A driving current flows through the fifth pixel switching element T5, the first pixel switching element T1 and the sixth pixel switching element T6 to drive the organic light emitting element OLED. An intensity of the driving current may be determined by the level of the data voltage VDATA. A luminance of the organic light emitting element OLED is determined by the intensity of the driving current. The driving current ISD flowing through a path from the input electrode to the output electrode of the first pixel switching element T1 is determined as following Equation 1.

$$ISD = \frac{1}{2}\mu Cox\frac{W}{L}(VSG - |VTH|)^2 \quad \text{[Equation 1]}$$

In Equation 1, μ is a mobility of the first pixel switching element T1. Cox is a capacitance per unit area of the first pixel switching element T1. W/L is a width to length ratio of the first pixel switching element T1. VSG is a voltage between the input electrode N2 of the first pixel switching element T1 and the control node N1 of the first pixel switching element T1. |VTH| is the threshold voltage of the first pixel switching element T1.

The voltage VG of the first node N1 after the compensation of the threshold voltage |VTH| during the second duration DU2 may be represented as following Equation 2.

$$VG = VDATA - |VTH| \quad \text{[Equation 2]}$$

When the organic light emitting element OLED emits the light during the fourth duration DU4, the driving voltage VOV and the driving current ISD may be represented as following Equations 3 and 4. In Equation 3, VS is a voltage of the second node N2.

$$VOV = VS - VG - |VTH| = ELVDD - (VDATA - |VTH|) - |VTH| = ELVDD - VDATA \quad \text{[Equation 3]}$$

$$ISD = \frac{1}{2}\mu Cox\frac{W}{L}(ELVDD - VDATA)^2 \quad \text{[Equation 4]}$$

The threshold voltage |VTH| is compensated during the second duration DU2, so that the driving current ISD may be determined regardless of the threshold voltage |VTH| of the first pixel switching element T1 when the organic light emitting element OLED emits the light during the fourth duration DU4.

In some example embodiments, when the image displayed on the display panel 100 is a static image or the display panel is operated in Always On Mode, a driving frequency of the display panel 100 may be decreased to reduce a power consumption. When all of the switching elements of the pixel of the display panel 100 are polysilicon thin film transistor, a flicker may be generated due to a leakage current of the pixel switching element in the low frequency driving mode. Thus, some of the pixel switching elements may be designed using the oxide thin film transistors. In some example embodiments, the third pixel switching element T3, the fourth pixel switching element T4 and the seventh pixel switching element T7 may be the oxide thin film transistors. The first pixel switching element T1, the second pixel switching element T2, the fifth pixel switching element T5 and the sixth pixel switching element T6 may be the polysilicon thin film transistors.

Figure 4A:
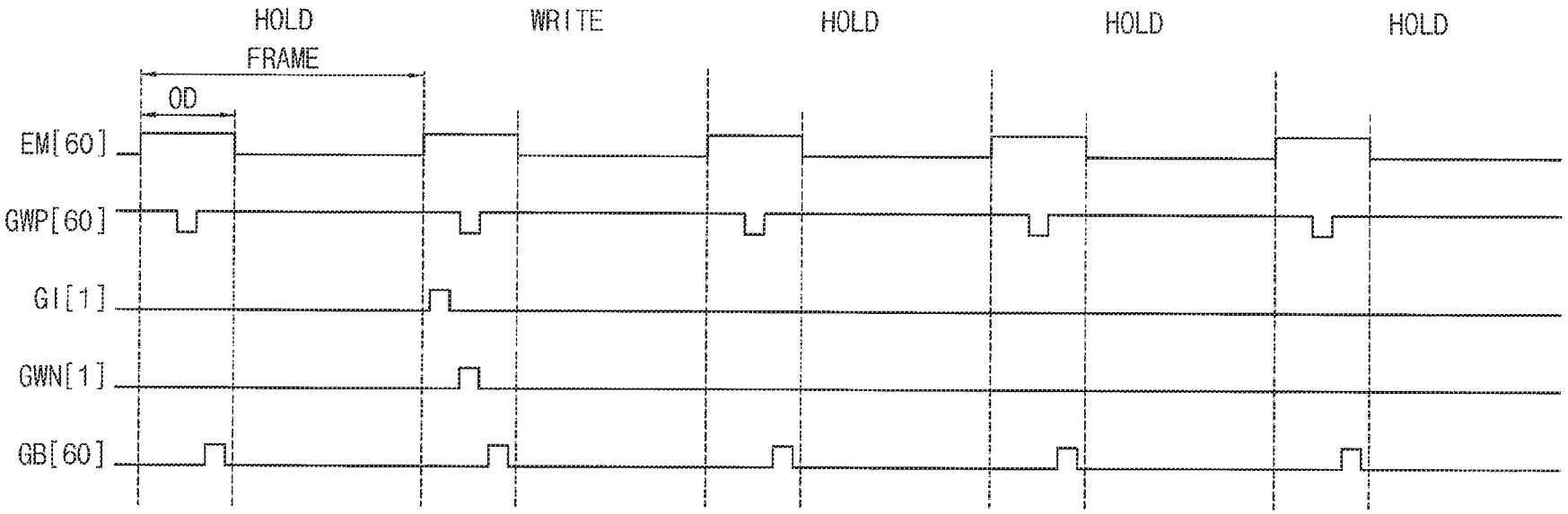
FIG. 4A is a timing diagram illustrating input signals applied to the pixels of the display panel in a low frequency driving mode without a writing compensation frame according to some example embodiments of the present inventive concept.
Figure 4B:
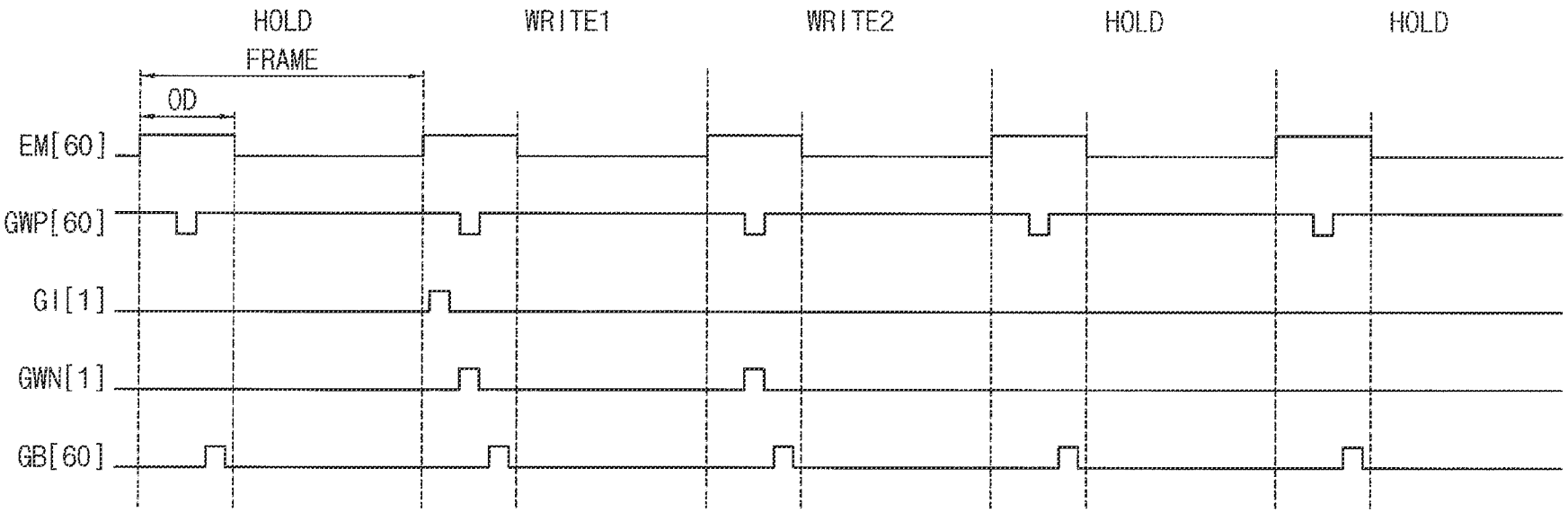
FIG. 4B is a timing diagram illustrating input signals applied to the pixels of the display panel of FIG. 2 in a low frequency driving mode with a writing compensation frame.

FIG. 4A is a timing diagram illustrating input signals applied to the pixels of the display panel in a low frequency driving mode without a writing compensation frame according to some example embodiments. FIG. 4B is a timing diagram illustrating input signals applied to the pixels of the display panel 100 of FIG. 2 in a low frequency driving mode with a writing compensation frame.

Referring to FIGS. 1 to 4B, the display panel 100 may be driven in a normal driving mode in which the display panel 100 is driven in a normal driving frequency and in a low frequency driving mode in which the display panel 100 is driven in a frequency less than the normal driving frequency.

For example, when the input image data represent a video image, the display panel 100 may be driven in the normal driving mode. For example, when the input image data represent a static image, the display panel may be driven in the low frequency driving mode. For example, when the display apparatus is operated in the always on mode, the display panel may be driven in the low frequency driving mode.

The display panel 100 may be driven in a unit of frame. The display panel 100 may be refreshed in every frame in the normal driving mode. Thus, the normal driving mode includes only writing frames in which the data is written in the pixel.

The display panel 100 may be refreshed in the frequency of the low frequency driving mode in the low frequency driving mode. Thus, the low frequency driving mode includes the writing frames in which the data is written in the pixel and holding frames in which the written data is maintained without writing the data in the pixel.

FIG. 4A represents an example embodiment including only the writing frame WRITE and the holding frame HOLD. For example, when the frequency of the normal driving mode is 60 Hz and the frequency of the low frequency driving mode is 1 Hz, the low frequency driving mode includes one writing frame WRITE and fifty nine holding frames HOLD in a second. For example, when the frequency of the normal driving mode is 60 Hz and the frequency of the low frequency driving mode is 1 Hz, fifty nine continuous holding frames HOLD are located between two adjacent writing frames WRITE.

For example, when the frequency of the normal driving mode is 60 Hz and the frequency of the low frequency driving mode is 10 Hz, the low frequency driving mode includes ten writing frame WRITE and fifty holding frames HOLD in a second. For example, when the frequency of the normal driving mode is 60 Hz and the frequency of the low frequency driving mode is 10 Hz, five continuous holding frames HOLD are located between two adjacent writing frames WRITE.

In some example embodiments, the second data write gate signal GWN and the data initialization gate signal GI may have a first frequency in the low frequency driving mode. The first frequency may be the frequency of the low frequency driving mode. In contrast, the first data write gate signal GWP, the emission signal EM and the organic light emitting element initialization gate signal GB may have a second frequency greater than the first frequency. The second frequency may be the normal frequency of the normal driving mode. In FIG. 4A, the first frequency is 1 Hz and the second frequency is 60 Hz.

The emission signal EM in the frame may include an emission off duration OD when the emission signal EM has the inactive level and an emission on duration when the emission signal EM has the active level.

FIG. 4B represents an example embodiment including the writing frame WRITE1, the holding frame HOLD and the writing compensation frame WRITE2. The writing compensation frame WRITE2 may be located immediately after the writing frame WRITE1.

In some example embodiments, only one writing compensation frame WRITE2 may be generated between adjacent writing frames WRITE1.

For example, when the frequency of the normal driving mode is 60 Hz and the frequency of the low frequency driving mode is 1 Hz, the low frequency driving mode includes one writing frame WRITE1, one writing compensation frame WRITE2 and fifty eight holding frames HOLD in a second.

In the writing frame WRITE1, the second data write gate signal GWN may have an active level. In the writing frame WRITE1, the second data write gate signal GWN may have at least one active pulse. Herein, the active level may be a high level. In the writing frame WRITE1, the data initialization gate signal GI may have an active level. In the writing frame WRITE1, the data initialization gate signal GI may have at least one active pulse. Herein, the active level may be a high level.

However, in the holding frame HOLD, the second data write gate signal GWN may not have the active level. In the holding frame HOLD, the data initialization gate signal GI may not have the active level.

In the writing compensation frame WRITE2, the second data write gate signal GWN may have the active level. In the writing compensation frame WRITE2, the second data write gate signal GWN may have at least one active pulse. However, in the writing compensation frame WRITE2, the data initialization gate signal GI may not have the active level so that the control electrode N1 of the first pixel switching element T1 may not initialized by the initialization voltage VI.

Figure 5A:
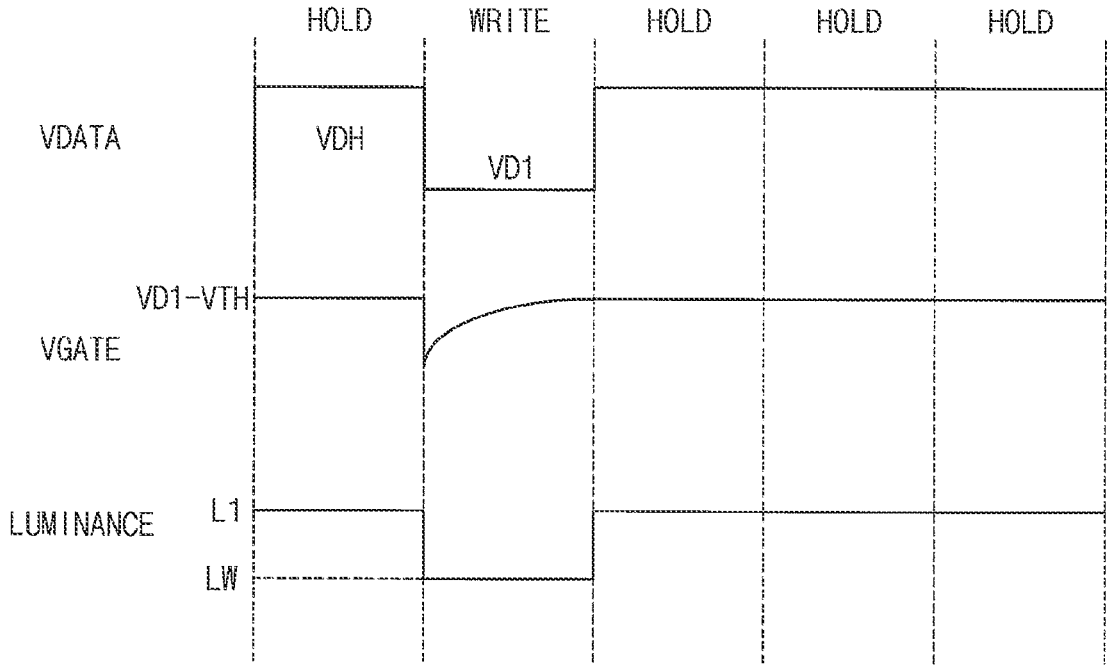
FIG. 5A is a timing diagram illustrating a gate voltage and a data voltage of a first pixel switching element and a luminance of an image in the low frequency driving mode without the writing compensation frame according to some example embodiments of the present inventive concept.
Figure 5B:
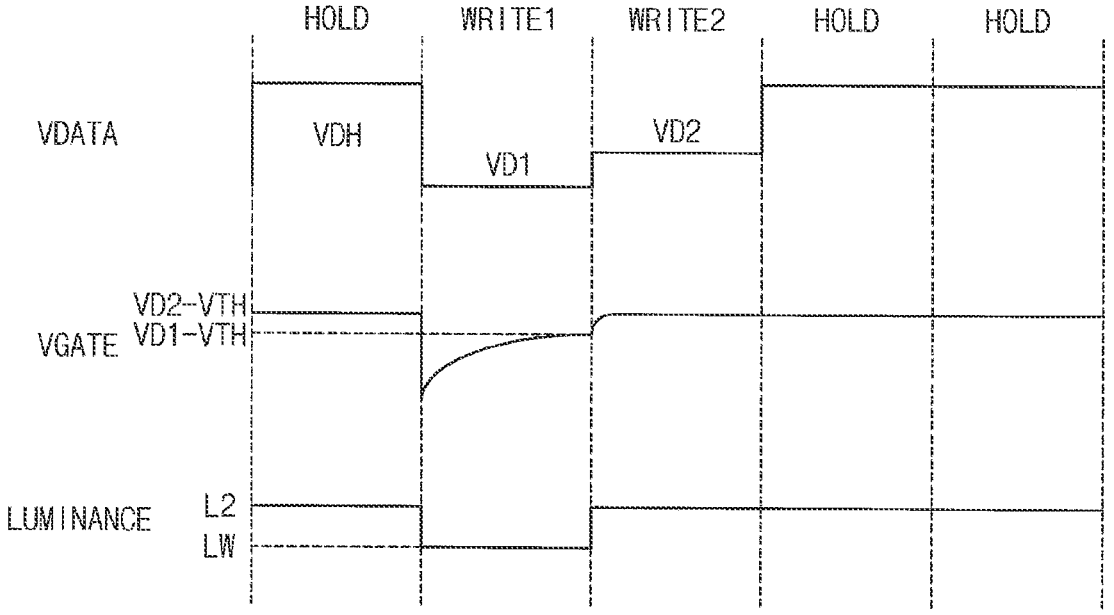
FIG. 5B is a timing diagram illustrating a gate voltage and a data voltage of a first pixel switching element of FIG. 2 and a luminance of an image in the low frequency driving mode with the writing compensation frame.

FIG. 5A is a timing diagram illustrating a gate voltage and a data voltage of the first pixel switching element T1 and a luminance of an image in the low frequency driving mode without the writing compensation frame according to some example embodiments. FIG. 5B is a timing diagram illustrating a gate voltage and a data voltage of the first pixel switching element T1 of FIG. 2 and a luminance of an image in the low frequency driving mode with the writing compensation frame.

Referring to FIGS. 1 to 3, 4A and 5A, in the writing frame WRITE, the data driver 500 may apply a first data voltage VD1 corresponding to a target grayscale to the pixel.

In the writing frame WRITE, the gate voltage VGATE of the first pixel switching element T1 is initialized by the initialization voltage VI in the first duration DU1 of FIG. 3 and gradually increase towards a level of VD1-VTH in the second duration DU2 of FIG. 3.

In the holding frame HOLD, the data driver 500 may apply a holding data voltage VDH not related with the target grayscale to the pixel. The holding data voltage VDH may be a voltage corresponding to a black image.

In the holding frame HOLD, the third pixel switching element T3 and the fourth pixel switching element T4 are not turned and the gate voltage VGATE of the first pixel switching element T1 maintains the level of VD1-VTH.

Due to the hysteresis of the first pixel switching element T1, the image in the writing frame WRITE and the image in the holding frame HOLD may have a little luminance difference L1-LW. The luminance difference L1-LW may generate a flicker of the display panel 100.

Referring to FIGS. 1 to 3, 4B and 5B, in the writing frame WRITE1, the data driver 500 may apply a first data voltage VD1 corresponding to a target grayscale to the pixel.

In the writing frame WRITE1, the gate voltage VGATE of the first pixel switching element T1 is initialized by the initialization voltage VI in the first duration DU1 of FIG. 3 and gradually increase towards a level of VD1-VTH in the second duration DU2 of FIG. 3.

In some example embodiments, the writing compensation frame WRITE2 may be located after the writing frame WRITE1.

In the writing compensation frame WRITE2, the data driver 500 may apply a second data voltage VD2 corresponding to the target grayscale to the pixel. The second data voltage VD2 may be different from the first data voltage VD1. A second luminance L2 corresponding to the second data voltage VD2 may be less than a first luminance L1 corresponding to the first data voltage VD1. The second data voltage VD2 may be greater than the first data voltage VD1.

In the writing compensation frame WRITE2, the gate voltage VGATE of the first pixel switching element T1 is not initialized in the first duration DU1 of FIG. 3 and gradually increase from the level of VD1-VTH towards a level of VD2-VTH in the second duration DU2 of FIG. 3.

In the holding frame HOLD, the data driver 500 may apply a holding data voltage VDH not related with the target grayscale to the pixel. The holding data voltage VDH may be a voltage corresponding to a black image.

In the holding frame HOLD, the third pixel switching element T3 and the fourth pixel switching element T4 are not turned and the gate voltage VGATE of the first pixel switching element T1 maintains the level of VD2-VTH.

The gate voltage VGATE in the holding frame HOLD in the comparative example embodiment of FIG. 5A is VD1-VTH and the gate voltage VGATE in the holding frame HOLD in the example embodiment of FIG. 5B is VD2-VTH. In some example embodiments, the gate voltage VGATE is increased in the writing compensation frame WRITE2 compared to the comparative example embodiment of FIG. 5A so that the luminance L2 of the image in the holding frame HOLD may be reduced compared to the example embodiment of FIG. 5A. Thus, the luminance difference L2-LW between the image of the writing frame WRITE1 and the image of the holding frame HOLD so that the flicker of the display panel 100 may be prevented or reduced.

According to some example embodiments, the display panel 100 may be driven in the low driving frequency mode so that the power consumption of the display apparatus may be reduced. In addition, the flicker may be prevented in the low driving frequency mode so that the display quality of the display panel 100 may be enhanced.

Figure 6:
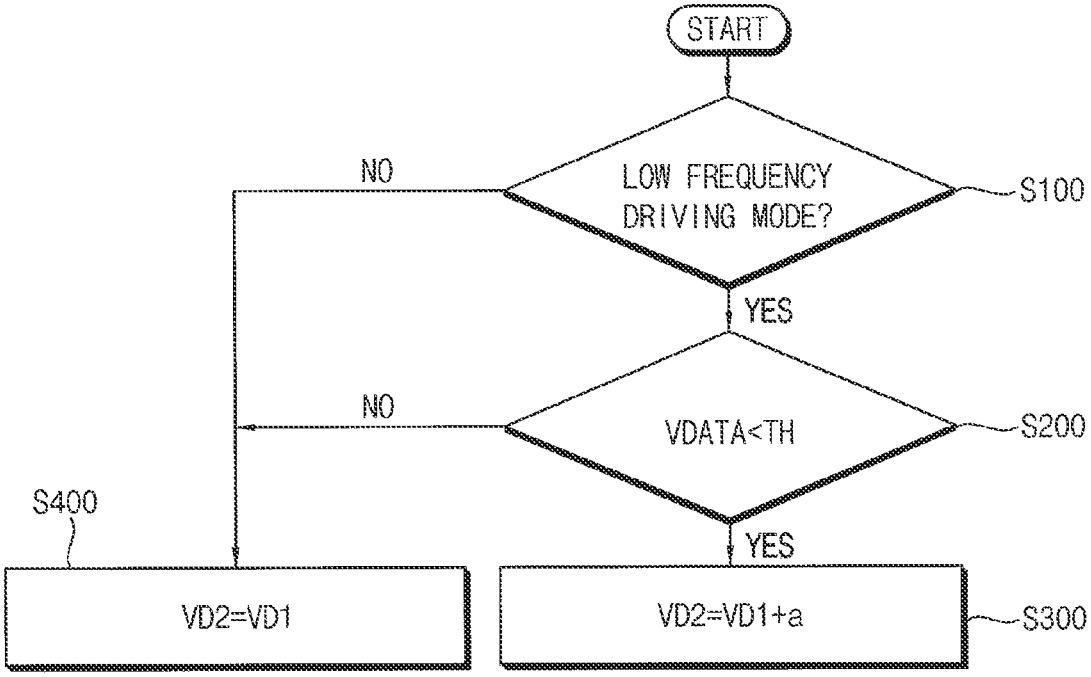
FIG. 6 is a flowchart diagram illustrating a method of driving a display panel in a low frequency driving mode according to some example embodiments of the present inventive concept.

FIG. 6 is a flowchart diagram illustrating a method of driving the display panel 100 in the low frequency driving mode according to some example embodiments of the present inventive concept.

Referring to FIGS. 1 to 6, the flicker may not be generated in the normal driving mode having the high driving frequency. In addition, the flicker may not be shown to a user in a high grayscale region having a high target grayscale.

Thus, the luminance compensation may be selectively applied when a display mode is the low frequency driving mode and the grayscale value of the data voltage VDATA is less than a threshold grayscale value TH.

In the method of driving the display panel 100 according to some example embodiments, it is determined whether the display apparatus is driven in the low frequency driving mode (S100).

When the display mode is the low frequency driving mode, the grayscale value of the data voltage VDATA is compared to the threshold grayscale value TH (S200).

When the display mode is the low frequency driving mode and the grayscale value of the data voltage VDATA is less than the threshold grayscale value TH, the data driver 500 outputs a first data voltage VD1 to the pixel in the writing frame WRITE1 and a second data voltage VD2 different from the first data voltage VD1 to the pixel in the writing compensation frame WRITE2 (S300).

When the display mode is not the low frequency driving mode or the grayscale value of the data voltage VDATA is equal to or greater than the threshold grayscale value TH, the data driver 500 may output the first data voltage VD1 to the pixel in the writing frame WRITE1 and the second data voltage VD2 equal to the first data voltage VD1 to the pixel in the writing compensation frame WRITE2 (S400).

At S300, the second data voltage VD2 may be greater than the first data voltage VD1 by a. In contrast, at S400, the second data voltage VD2 may be equal to the first data voltage VD1.

Accordingly, the display panel 100 may represent luminance in the holding frame HOLD according to S300, in which the luminance compensation is operated, less than luminance in the holding frame HOLD according to S400, in which the luminance compensation is not operated.

In some example embodiments, the comparing the grayscale value of the data voltage VDATA and the threshold grayscale value TH and the determining of the second data voltage VD2 different from the first data voltage VD1 or equal to the first data voltage VD1 may be operated for every horizontal line.

Figure 7:
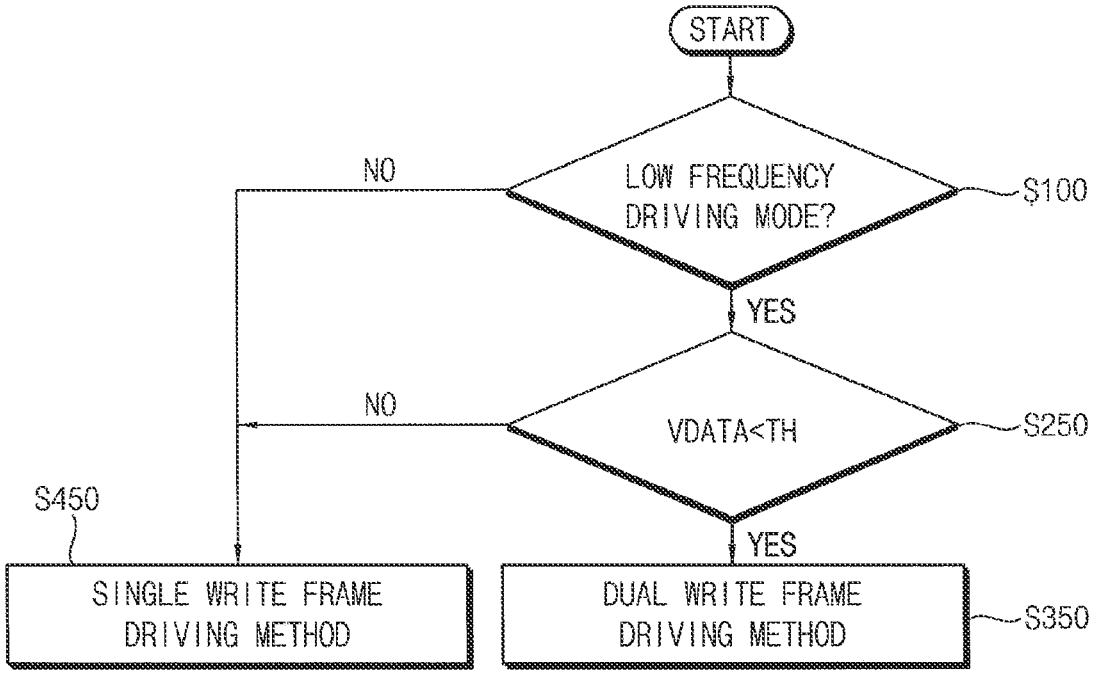
FIG. 7 is a flowchart diagram illustrating a method of driving a display panel in a low frequency driving mode according to some example embodiments of the present inventive concept.

FIG. 7 is a flowchart diagram illustrating a method of driving the display panel 100 in the low frequency driving mode according to some example embodiments of the present inventive concept.

Referring to FIGS. 1 to 5B and 7, the flicker may not be generated in the normal driving mode having the high driving frequency. In addition, the flicker may not be shown to a user in a high grayscale region having a high target grayscale.

Thus, the luminance compensation may be selectively applied when a display mode is the low frequency driving mode and the grayscale value of the data voltage VDATA is less than a threshold grayscale value TH.

In the method of driving the display panel 100 according to some example embodiments, it is determined whether the display apparatus is driven in the low frequency driving mode (S100).

When the display mode is the low frequency driving mode, the grayscale value of the data voltage VDATA is compared to the threshold grayscale value TH (S250).

When the display mode is the low frequency driving mode and the grayscale value of the data voltage VDATA is less than the threshold grayscale value TH, the display apparatus may generate the writing compensation frame WRITE2 (S350). When the writing compensation frame WRITE2 is generated, driving frames of the display panel 100 include the writing frame WRITE1 and the writing compensation frame WRITE2 so that the above driving method may be referred to a dual write frame driving method.

When the display mode is not the low frequency driving mode or the grayscale value of the data voltage VDATA is equal to or greater than the threshold grayscale value TH, the display apparatus may not generate the writing compensation frame WRITE2 (S450). When the writing compensation frame WRITE2 is not generated, driving frames of the display panel 100 merely include the writing frame WRITE1 and the holding frame HOLD so that the above driving method may be referred to a single write frame driving method.

In some example embodiments, the comparing of the grayscale value of the data voltage VDATA and the threshold grayscale value TH and the generating of the writing compensation frame WRITE2 or not may be operated for every horizontal line. In some example embodiments, the data voltage VDATA may represent frame data. When the grayscale value of the data voltage VDATA is compared to the threshold grayscale value TH, a worst pattern in the frame data may be compared to the threshold grayscale value TH to determine the generation of the writing compensation frame WRITE2.

Figure 8:
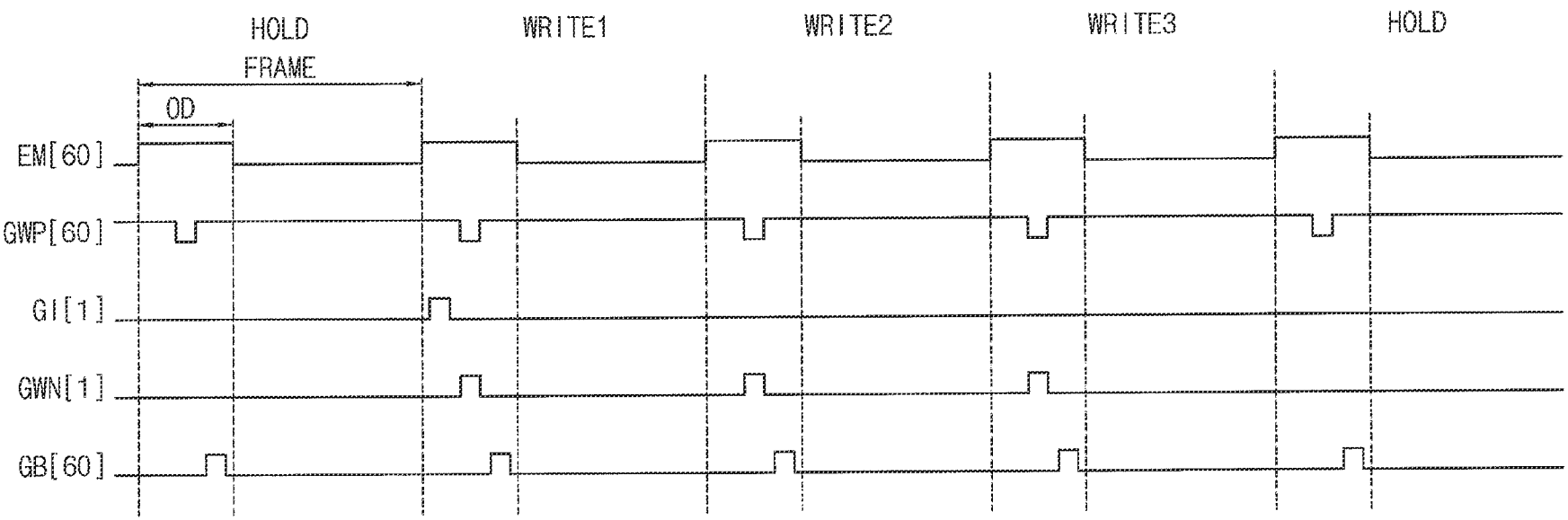
FIG. 8 is a timing diagram illustrating input signals applied to pixels of a display panel in a low frequency driving mode with a writing compensation frame according to some example embodiments of the present inventive concept.
Figure 9:
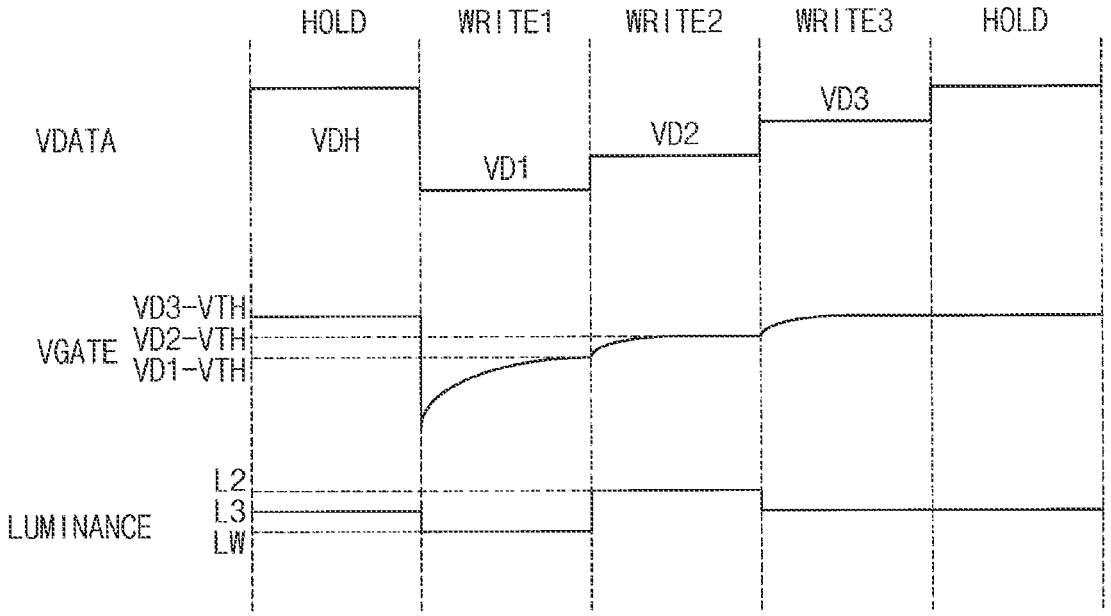
FIG. 9 is a timing diagram illustrating a gate voltage and a data voltage of a first pixel switching element and a luminance of an image in a low frequency driving mode with a writing compensation frame according to some example embodiments of the present inventive concept.

FIG. 8 is a timing diagram illustrating input signals applied to pixels of a display panel in a low frequency driving mode with a writing compensation frame according to some example embodiments of the present inventive concept. FIG. 9 is a timing diagram illustrating a gate voltage and a data voltage of a first pixel switching element and a luminance of an image in a low frequency driving mode with a writing compensation frame according to some example embodiments of the present inventive concept.

The display apparatus and the method of driving the display panel according to some example embodiments is substantially the same as the display apparatus and the method of driving the display panel of the previous example embodiment explained referring to FIGS. 1 to 5B except that two writing compensation frames are inserted after the writing frame. Thus, the same reference numerals will be used to refer to the same or like parts as those described in the previous example embodiment of FIGS. 1 to 5B and some repetitive explanation concerning the above elements may be omitted.

Referring to FIGS. 1 to 3, 8, and 9, the display apparatus includes a display panel 100 and a display panel driver. The display panel driver includes a driving controller 200, a gate driver 300, a gamma reference voltage generator 400, a data driver 500 and an emission driver 600.

The display panel 100 includes the plurality of the pixels. Each pixel includes an organic light emitting element OLED.

In some example embodiments, the pixel may include a switching element of a first type and a switching element of a second type different from the first type. For example, the switching element of the first type may be a polysilicon thin film transistor. For example, the switching element of the first type may be a low temperature polysilicon (LTPS) thin film transistor. For example, the switching element of the second type may be an oxide thin film transistor. For example, the switching element of the first type may be a P-type transistor and the switching element of the second type may be an N-type transistor.

FIG. 8 represents an example embodiment including the writing frame WRITE1, the holding frame HOLD and two writing compensation frames WRITE2 and WRITE3. A first writing compensation frame WRITE2 may be located right after the writing frame WRITE1. A second writing compensation frame WRITE3 may be located right after the first writing compensation frame WRITE2.

For example, when the frequency of the normal driving mode is 60 Hz and the frequency of the low frequency driving mode is 1 Hz, the low frequency driving mode includes one writing frame WRITE1, two writing compensation frames WRITE2 and WRITE3 and fifty seven holding frames HOLD in a second.

In the writing frame WRITE1, the data driver 500 may apply a first data voltage VD1 corresponding to a target grayscale to the pixel.

In the writing frame WRITE1, the gate voltage VGATE of the first pixel switching element T1 is initialized by the initialization voltage VI in the first duration DU1 of FIG. 3 and gradually increase towards a level of VD1-VTH in the second duration DU2 of FIG. 3.

In some example embodiments, the first writing compensation frame WRITE2 may be located after the writing frame WRITE1.

In the first writing compensation frame WRITE2, the data driver 500 may apply a second data voltage VD2 corresponding to the target grayscale to the pixel. The second data voltage VD2 may be different from the first data voltage VD1. A second luminance L2 corresponding to the second data voltage VD2 may be less than a first luminance L1 corresponding to the first data voltage VD1. The second data voltage VD2 may be greater than the first data voltage VD1.

In the first writing compensation frame WRITE2, the gate voltage VGATE of the first pixel switching element T1 is not initialized in the first duration DU1 of FIG. 3 and gradually increase from the level of VD1-VTH towards a level of VD2-VTH in the second duration DU2 of FIG. 3.

In some example embodiments, the second writing compensation frame WRITE3 may be located after the first writing compensation frame WRITE2.

In the second writing compensation frame WRITE3, the data driver 500 may apply a third data voltage VD3 corresponding to the target grayscale to the pixel. The third data voltage VD3 may be different from the first data voltage VD1 and the second data voltage VD2. A third luminance L3 corresponding to the third data voltage VD3 may be less than a second luminance L2 corresponding to the second data voltage VD2. The third data voltage VD3 may be greater than the second data voltage VD2.

In the second writing compensation frame WRITE3, the gate voltage VGATE of the first pixel switching element T1 is not initialized in the first duration DU1 of FIG. 3 and gradually increase from the level of VD2-VTH towards a level of VD3-VTH in the second duration DU2 of FIG. 3.

In the holding frame HOLD, the data driver 500 may apply a holding data voltage VDH not related with the target grayscale to the pixel. The holding data voltage VDH may be a voltage corresponding to a black image.

In the holding frame HOLD, the third pixel switching element T3 and the fourth pixel switching element T4 are not turned and the gate voltage VGATE of the first pixel switching element T1 maintains the level of VD3-VTH.

The gate voltage VGATE in the holding frame HOLD in the example embodiment of FIG. 5A is VD1-VTH and the gate voltage VGATE in the holding frame HOLD in the present example embodiment of FIG. 9 is VD3-VTH. In some example embodiments, the gate voltage VGATE is increased in the first and second writing compensation frame WRITE2 and WRITE3 compared to the comparative example embodiment of FIG. 5A so that the luminance L3 of the image in the holding frame HOLD may be reduced compared to the example embodiment of FIG. 5A. Thus, the luminance difference L3-LW between the image of the writing frame WRITE1 and the image of the holding frame HOLD so that the flicker of the display panel 100 may be prevented or reduced.

According to some example embodiments, the display panel 100 may be driven in the low driving frequency mode so that the power consumption of the display apparatus may be reduced. In addition, the flicker may be prevented or reduced in the low driving frequency mode so that the display quality of the display panel 100 may be enhanced.

Figure 10:
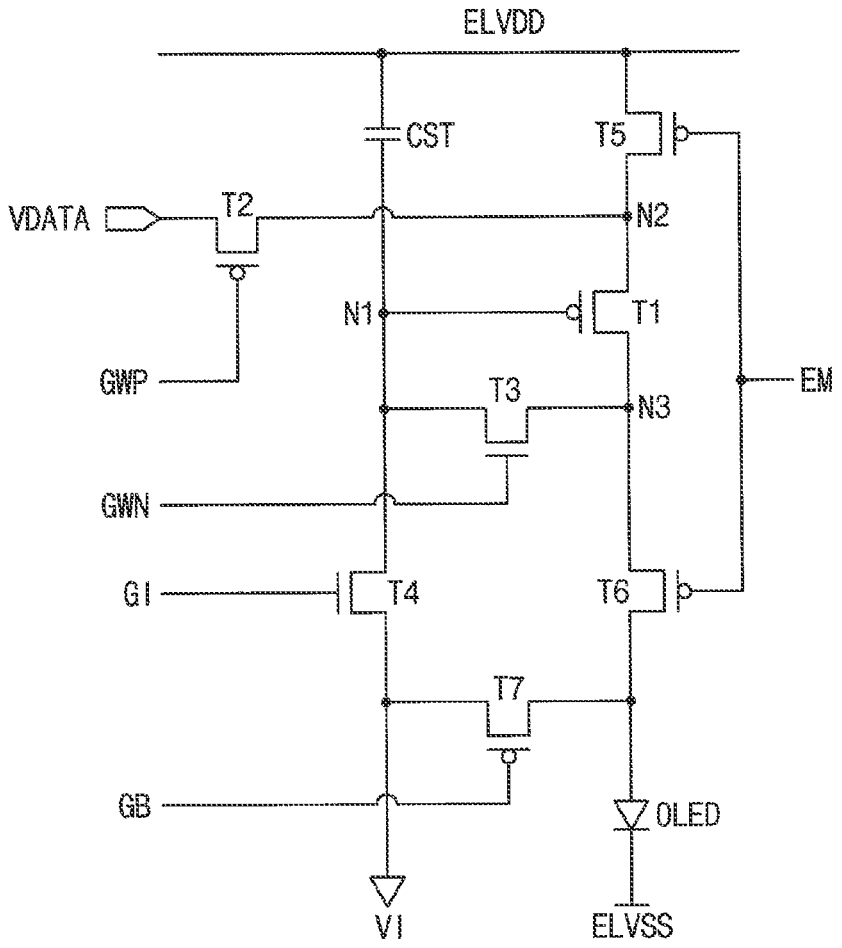
FIG. 10 is a circuit diagram illustrating a pixel of a display panel according to some example embodiments of the present inventive concept.
Figure 11:
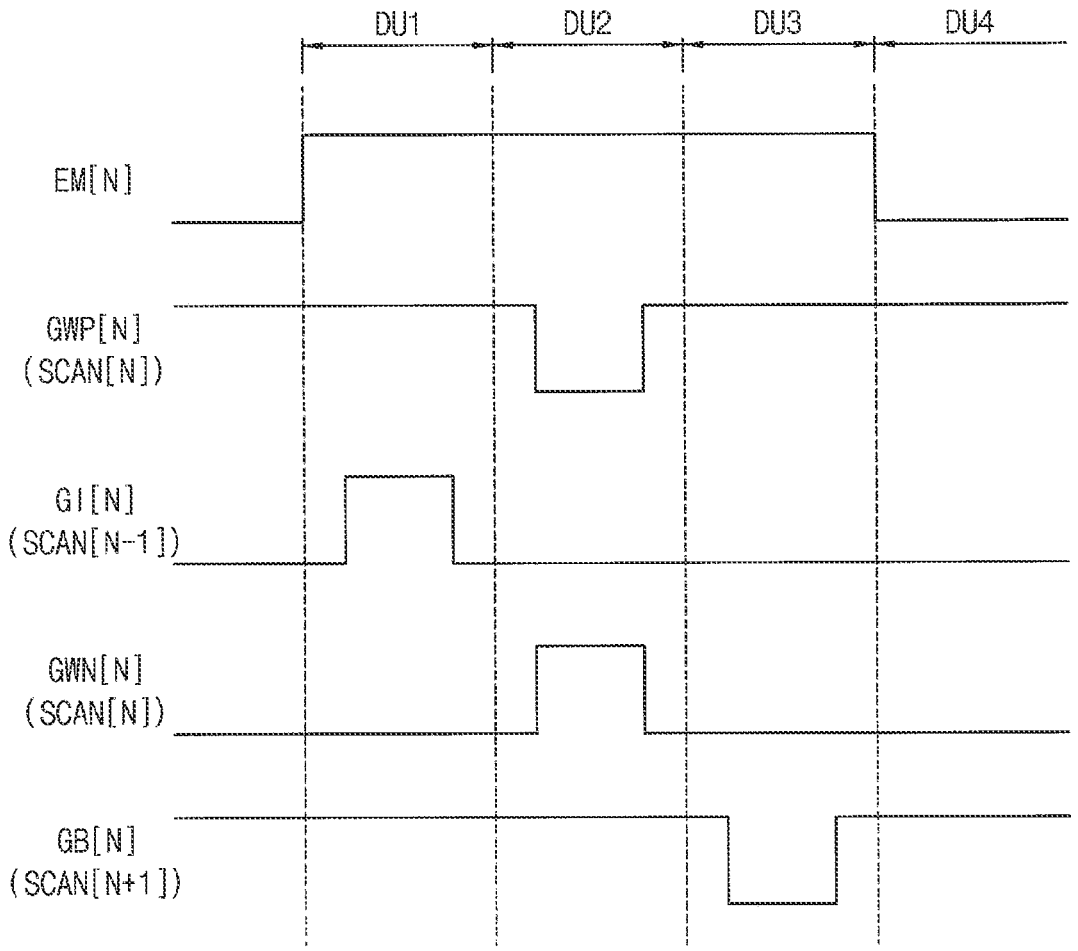
FIG. 11 is a timing diagram illustrating input signals applied to the pixel of FIG. 10.

FIG. 10 is a circuit diagram illustrating a pixel of a display panel 100 according to some example embodiments of the present inventive concept. FIG. 11 is a timing diagram illustrating input signals applied to the pixel of FIG. 10.

The display apparatus and the method of driving the display panel according to some example embodiments is substantially the same as the display apparatus and the method of driving the display panel of the previous example embodiment explained referring to FIGS. 1 to 5B except for the pixel structure. Thus, the same reference numerals will be used to refer to the same or like parts as those described in the previous example embodiment of FIGS. 1 to 5B and some repetitive explanation concerning the above elements may be omitted.

Referring to FIGS. 1, 4B, 5B, 10, and 11, the display apparatus includes a display panel 100 and a display panel driver. The display panel driver includes a driving controller 200, a gate driver 300, a gamma reference voltage generator 400, a data driver 500, and an emission driver 600.

The display panel 100 includes the plurality of the pixels. Each pixel includes an organic light emitting element OLED.

The pixel receives a data write gate signal GWP and GWN, a data initialization gate signal GI, an organic light emitting element initialization signal GB, the data voltage VDATA and the emission signal EM and the organic light emitting element OLED of the pixel emits light corresponding to the level of the data voltage VDATA to display the image.

In the present example embodiment, the pixel may include a switching element of a first type and a switching element of a second type different from the first type. For example, the switching element of the first type may be a polysilicon thin film transistor. For example, the switching element of the first type may be a low temperature polysilicon (LTPS) thin film transistor. For example, the switching element of the second type may be an oxide thin film transistor. For example, the switching element of the first type may be a P-type transistor and the switching element of the second type may be an N-type transistor.

At least one of the pixels may include first to seventh pixel switching elements T1 to T7, a storage capacitor CST and the organic light emitting element OLED.

In the present example embodiment, the seventh pixel switching element T7 includes a control electrode to which the organic light emitting element initialization gate signal GB is applied, an input electrode to which the initialization voltage VI is applied and an output electrode connected to the anode electrode of the organic light emitting element OLED.

For example, the seventh pixel switching element T7 may be the polysilicon thin film transistor. For example, the seventh pixel switching element T7 may be a P-type thin film transistor.

In FIG. 11, during a first duration (or time period) DU1, the first node N1 and the storage capacitor CST are initialized in response to the data initialization gate signal GI. During a second duration (or time period) DU2, a threshold voltage |VTH| of the first pixel switching element T1 is compensated and the data voltage VDATA of which the threshold voltage |VTH| is compensated is written to the first node N1 in response to the first and second data write gate signals GWP and GWN. During a third duration (or time period) DU3, the anode electrode of the organic light emitting element OLED is initialized in response to the organic light emitting element initialization gate signal GB. During a fourth duration (or time period) DU4, the organic light emitting element OLED emit the light in response to the emission signal EM so that the display panel 100 displays the image.

In the present example embodiment, the active level of the organic light emitting element initialization signal GB may be a low level.

In the present example embodiment, some of the pixel switching elements may be designed using the oxide thin film transistors. In the present example embodiment, the third pixel switching element T3 and the fourth pixel switching element T4 may be the oxide thin film transistors. The first pixel switching element T1, the second pixel switching element T2, the fifth pixel switching element T5, the sixth pixel switching element T6 and the seventh pixel switching element T7 may be the polysilicon thin film transistors.

In the present example embodiment, the gate voltage VGATE is increased in the writing compensation frame WRITE2 compared to the comparative example embodiment of FIG. 5A so that the luminance of the image in the holding frame HOLD may be reduced compared to the comparative example embodiment of FIG. 5A. Thus, the luminance difference between the image of the writing frame WRITE1 and the image of the holding frame HOLD so that the flicker of the display panel 100 may be prevented or reduced.

According to some example embodiments, the display panel 100 may be driven in the low driving frequency mode so that the power consumption of the display apparatus may be reduced. In addition, the flicker may be prevented or reduced in the low driving frequency mode so that the display quality of the display panel 100 may be enhanced.

Figure 12:
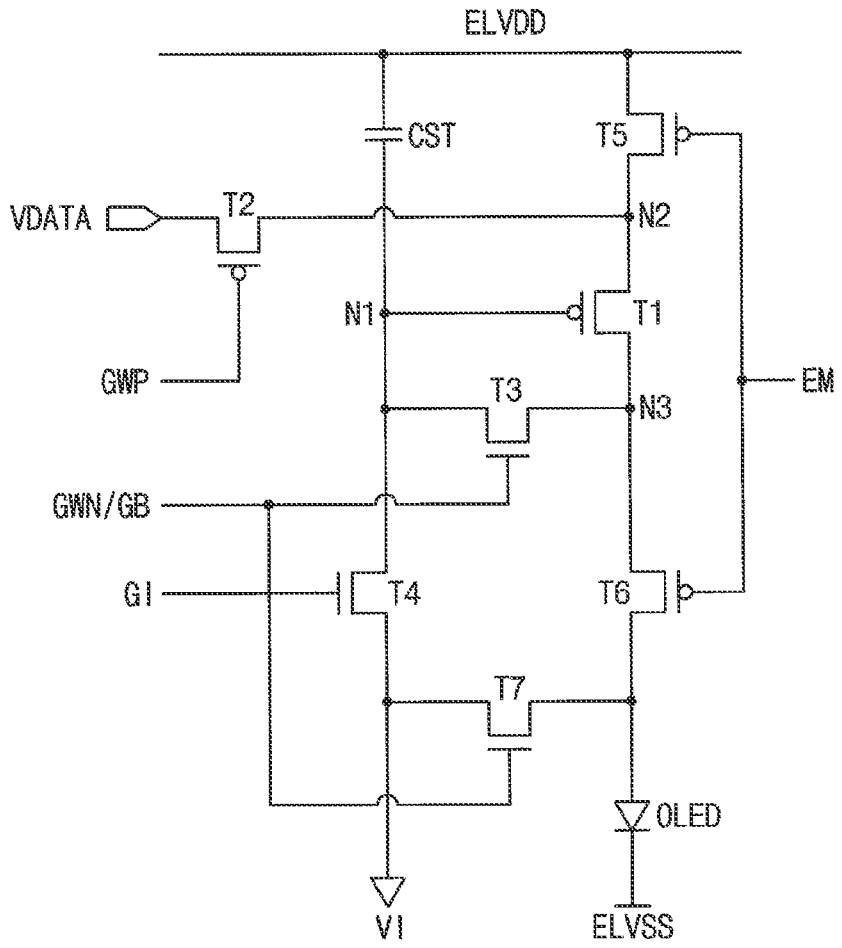
FIG. 12 is a circuit diagram illustrating a pixel of a display panel according to some example embodiments of the present inventive concept.
Figure 13:
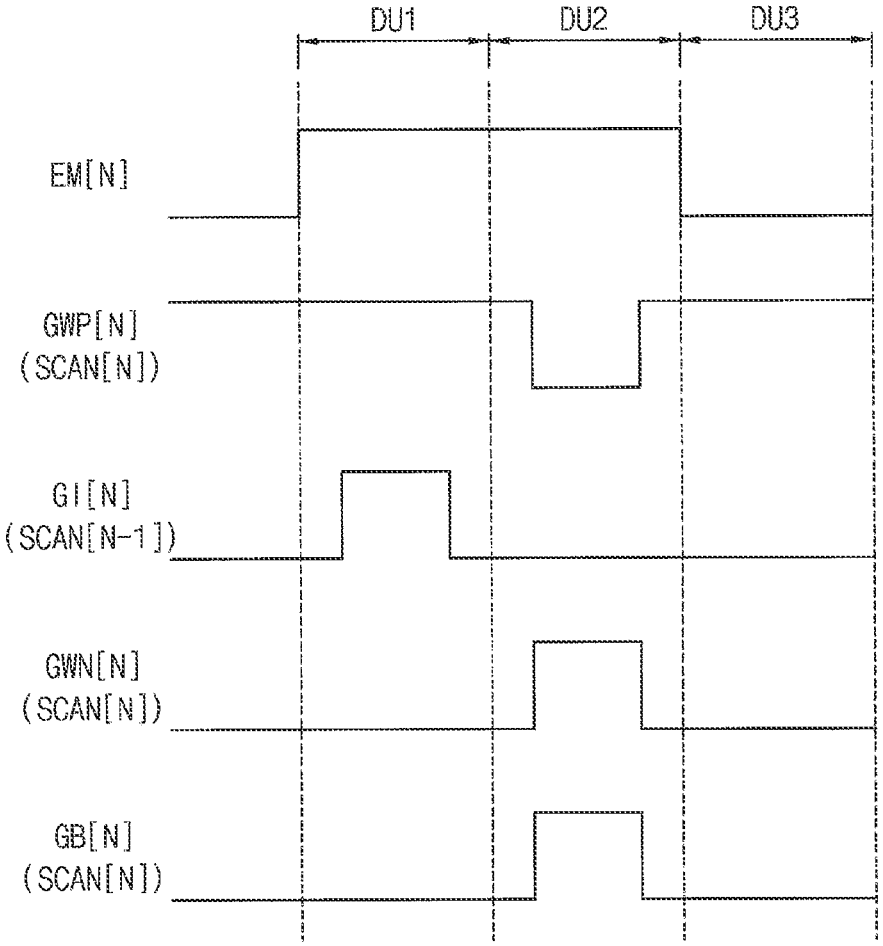
FIG. 13 is a timing diagram illustrating input signals applied to the pixel of FIG. 12.

FIG. 12 is a circuit diagram illustrating a pixel of a display panel 100 according to some example embodiments of the present inventive concept. FIG. 13 is a timing diagram illustrating input signals applied to the pixel of FIG. 12.

The display apparatus and the method of driving the display panel according to the present example embodiment is substantially the same as the display apparatus and the method of driving the display panel of the previous example embodiment explained referring to FIGS. 1 to 5B except for the pixel structure. Thus, the same reference numerals will be used to refer to the same or like parts as those described in the previous example embodiment of FIGS. 1 to 5B and some repetitive explanation concerning the above elements may be omitted.

Referring to FIGS. 1, 4B, 5B, 12 and 13, the display apparatus includes a display panel 100 and a display panel driver. The display panel driver includes a driving controller 200, a gate driver 300, a gamma reference voltage generator 400, a data driver 500 and an emission driver 600.

The display panel 100 includes the plurality of the pixels. Each pixel includes an organic light emitting element OLED.

The pixel receives a data write gate signal GWP and GWN, a data initialization gate signal GI, an organic light emitting element initialization signal GB, the data voltage VDATA and the emission signal EM and the organic light emitting element OLED of the pixel emits light corresponding to the level of the data voltage VDATA to display the image.

In some example embodiments, the pixel may include a switching element of a first type and a switching element of a second type different from the first type. For example, the switching element of the first type may be a polysilicon thin film transistor. For example, the switching element of the first type may be a low temperature polysilicon (LTPS) thin film transistor. For example, the switching element of the second type may be an oxide thin film transistor. For example, the switching element of the first type may be a P-type transistor and the switching element of the second type may be an N-type transistor.

At least one of the pixels may include first to seventh pixel switching elements T1 to T7, a storage capacitor CST and the organic light emitting element OLED.

The third pixel switching element T3 includes a control electrode to which the second data write gate signal GWN is applied, an input electrode connected to the first node N1 and an output electrode connected to the third node N3.

For example, the third pixel switching element T3 may be the oxide thin film transistor. For example, the third pixel switching element T3 may be the N-type thin film transistor.

The seventh pixel switching element T7 includes a control electrode to which the organic light emitting element initialization gate signal GB is applied, an input electrode to which the initialization voltage VI is applied and an output electrode connected to the anode electrode of the organic light emitting element OLED.

For example, the seventh pixel switching element T7 may be the oxide thin film transistor. For example, the seventh pixel switching element T7 may be the N-type thin film transistor.

In some example embodiments, the control electrode of the third pixel switching element T3 may be connected to the control electrode of the seventh pixel switching element T7. The organic light emitting element initialization gate signal GB may be the same as the second data write gate signal GWN.

Although the organic light emitting element initialization gate signal GB is same as the second data write gate signal GWN in the present example embodiment, the present inventive concept is not limited thereto. Alternatively, the organic light emitting element initialization gate signal GB may be the same as the data initialization gate signal GI.

In some example embodiments, the seventh pixel switching element T7 may be the P-type thin film transistor. When the seventh pixel switching element T7 is the P-type thin film transistor, the organic light emitting element initialization gate signal GB may be the same as the first data write gate signal GWP or the organic light emitting element initialization gate signal GB may be the same as the emission signal EM.

In FIG. 13, during a first duration DU1, the first node N1 and the storage capacitor CST are initialized in response to the data initialization gate signal GI. During a second duration DU2, a threshold voltage |VTH| of the first pixel switching element T1 is compensated and the data voltage VDATA of which the threshold voltage |VTH| is compensated is written to the first node N1 in response to the first and second data write gate signals GWP and GWN. In addition, during the second duration DU2, the anode electrode of the organic light emitting element OLED is initialized in response to the organic light emitting element initialization gate signal GB. During a third duration DU3, the organic light emitting element OLED emit the light in response to the emission signal EM so that the display panel 100 displays the image.

In some example embodiments, some of the pixel switching elements may be designed using the oxide thin film transistors. In some example embodiments, the third pixel switching element T3, the fourth pixel switching element T4 and the seventh pixel switching element T7 may be the oxide thin film transistors. The first pixel switching element T1, the second pixel switching element T2, the fifth pixel switching element T5 and the sixth pixel switching element T6 may be the polysilicon thin film transistors.

In some example embodiments, the gate voltage VGATE is increased in the writing compensation frame WRITE2 compared to the comparative example embodiment of FIG. 5A so that the luminance of the image in the holding frame HOLD may be reduced compared to the comparative example embodiment of FIG. 5A. Thus, the luminance difference between the image of the writing frame WRITE1 and the image of the holding frame HOLD so that the flicker of the display panel 100 may be prevented or reduced.

According to some example embodiments, the display panel 100 may be driven in the low driving frequency mode so that the power consumption of the display apparatus may be reduced. In addition, the flicker may be prevented or reduced in the low driving frequency mode so that the display quality of the display panel 100 may be enhanced.

According to some example embodiments of the present inventive concept as explained above, the power consumption of the display apparatus may be reduced and the display quality of the display panel may be enhanced.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the example embodiments of the present invention.

The foregoing is illustrative of some example embodiments of the present inventive concept and is not to be construed as limiting thereof. Although a few example embodiments of the present inventive concept have been described, those skilled in the art will readily appreciate that many modifications are possible in the example embodiments without materially departing from the novel teachings and characteristics of the present inventive concept. Accordingly, all such modifications are intended to be included within the scope of the present inventive concept as defined in the claims, and their equivalents. In the claims, means-plus-function clauses, only invoked by explicitly using the word "means," are intended to cover the structures described herein as performing the recited function and not only structural equivalents but also equivalent structures. Therefore, it is to be understood that the foregoing is illustrative of the present inventive concept and is not to be construed as limited to the specific example embodiments disclosed, and that modifications to the disclosed example embodiments, as well as other example embodiments, are intended to be included within the scope of the appended claims. The present inventive concept is defined by the following claims, with equivalents of the claims to be included therein.

What is claimed is:

1. A display apparatus comprising:

a display panel comprising a pixel, the pixel comprising:

a first pixel switching element comprising a control electrode connected to a first node, an input electrode connected to a second node, and an output electrode connected to a third node;

a second pixel switching element comprising a control electrode to receive a first data write gate signal, an input electrode to receive a data voltage, and an output electrode connected to the second node;

a third pixel switching element comprising a control electrode to receive a second data write gate signal different from the first data write gate signal, an input electrode connected to the first node, and an output electrode connected to the third node;

a fourth pixel switching element comprising a control electrode to receive a data initialization gate signal, an input electrode to receive an initialization voltage, and an output electrode connected to the first node; and an organic light emitting element to emit light based on a high power voltage, a low power voltage and a current flowing through the first pixel switching element;

a gate driver configured to:

output the second data write gate signal not having a corresponding active level and the data initialization gate signal not having a corresponding active level to the pixel in a holding frame; and output the second data write gate signal having the corresponding active level and the data initialization gate signal not having the corresponding active level to the pixel in a writing compensation frame;

a data driver configured to output the data voltage to the pixel; and an emission driver configured to output an emission signal to the pixel, wherein the writing compensation frame is generated based on a display mode of the display apparatus being a low frequency driving mode and a grayscale value of the data voltage being less than a threshold grayscale value.

2. The display apparatus of claim 1, wherein the gate driver is further configured to output the second data write gate signal having the corresponding active level and the data initialization gate signal having the corresponding active level to the pixel in a writing frame, and wherein the writing compensation frame is immediately after the writing frame.

3. The display apparatus of claim 2, wherein the data driver is configured to output a first data voltage for a target grayscale to the pixel in the writing frame and a second data voltage for the target grayscale different from the first data voltage to the pixel in the writing compensation frame.

4. The display apparatus of claim 3, wherein the data driver is configured to output a holding data voltage not related with the target grayscale to the pixel in the holding frame.

5. The display apparatus of claim 3, wherein a second luminance corresponding to the second data voltage is less than a first luminance corresponding to the first data voltage.

6. The display apparatus of claim 2, wherein the gate driver is configured to output the second data write gate signal having the corresponding active level and the data initialization gate signal not having the corresponding active level to the pixel in a second writing compensation frame, and wherein the second writing compensation frame is immediately after the writing compensation frame.

7. The display apparatus of claim 6, wherein the data driver is configured to output a first data voltage for a target grayscale to the pixel in the writing frame, a second data voltage for the target grayscale different from the first data voltage to the pixel in the writing compensation frame, and a third data voltage for the target grayscale different from the first data voltage and the second data voltage to the pixel in the second writing compensation frame.

8. The display apparatus of claim 7, wherein a second luminance corresponding to the second data voltage is less than a first luminance corresponding to the first data voltage, and wherein a third luminance corresponding to the third data voltage is less than the second luminance corresponding to the second data voltage.

9. The display apparatus of claim 1, wherein the pixel comprises a switching element of a first type and a switching element of a second type different from the first type.

10. The display apparatus of claim 9, wherein the switching element of the first type is a polysilicon thin film transistor, and wherein the switching element of the second type is an oxide thin film transistor.

11. The display apparatus of claim 10, wherein the switching element of the first type is a P-type transistor, and wherein the switching element of the second type is an N-type transistor.

12. The display apparatus of claim 10, wherein the pixel further comprises:

a fifth pixel switching element comprising a control electrode to receive the emission signal, an input electrode to receive the high power voltage, and an output electrode connected to the second node;

a sixth pixel switching element comprising a control electrode to receive the emission signal, an input electrode connected to the third node, and an output electrode connected to an anode electrode of the organic light emitting element;

a seventh pixel switching element comprising a control electrode to receive an organic light emitting element initialization gate signal, an input electrode to receive the initialization voltage, and an output electrode connected to the anode electrode of the organic light emitting element; and a storage capacitor comprising a first electrode to receive the high power voltage and a second electrode connected to the first node, and wherein the organic light emitting element comprises the anode electrode connected to the output electrode of the sixth pixel switching element and a cathode electrode to receive the low power voltage.

13. The display apparatus of claim 12, wherein the first pixel switching element, the second pixel switching element, the fifth pixel switching element, and the sixth pixel switching element are the polysilicon thin film transistors, and wherein the third pixel switching element, the fourth pixel switching element, and the seventh pixel switching element are the oxide thin film transistors.

14. The display apparatus of claim 13, wherein the control electrode of the third pixel switching element is connected to the control electrode of the seventh pixel switching element.

15. The display apparatus of claim 12, wherein the first pixel switching element, the second pixel switching element, the fifth pixel switching element, the sixth pixel switching element, and the seventh pixel switching element are the polysilicon thin film transistors, and wherein the third pixel switching element and the fourth pixel switching element are the oxide thin film transistors.

16. The display apparatus of claim 1, wherein the writing compensation frame is not generated when the display mode is not the low frequency driving mode or the grayscale value of the data voltage is equal to or greater than the threshold grayscale value.

17. A display apparatus comprising:

a display panel comprising a pixel, the pixel comprising:

a first pixel switching element comprising a control electrode connected to a first node, an input electrode connected to a second node, and an output electrode connected to a third node;

a second pixel switching element comprising a control electrode to receive a first data write gate signal, an input electrode to receive a data voltage, and an output electrode connected to the second node;

a third pixel switching element comprising a control electrode to receive a second data write gate signal different from the first data write gate signal, an input electrode connected to the first node, and an output electrode connected to the third node;

a fourth pixel switching element comprising a control electrode to receive a data initialization gate signal, an input electrode to receive an initialization voltage, and an output electrode connected to the first node; and an organic light emitting element to emit light based on a high power voltage, a low power voltage and a current flowing through the first pixel switching element;

a gate driver configured to:

output the second data write gate signal not having a corresponding active level and the data initialization gate signal not having a corresponding active level to the pixel in a holding frame; and output the second data write gate signal having the corresponding active level and the data initialization gate signal not having the corresponding active level to the pixel in a writing compensation frame;

a data driver configured to output the data voltage to the pixel; and an emission driver configured to output an emission signal to the pixel, wherein the data driver is configured to output a first data voltage to the pixel in a writing frame and a second data voltage different from the first data voltage to the pixel in the writing compensation frame when a display mode of the display apparatus is a low frequency driving mode and a grayscale value of the data voltage is less than a threshold grayscale value, and the data driver is configured to output the first data voltage to the pixel in the writing frame and the first data voltage to the pixel in the writing compensation frame when the display mode is not the low frequency driving mode or the grayscale value of the data voltage is equal to or greater than the threshold grayscale value.

* * * * *